United States Patent [19]

Sweeney

[11] Patent Number: 4,776,756

[45] Date of Patent: Oct. 11, 1988

[54] PUMP

[75] Inventor: William T. Sweeney, Halesowen, England

[73] Assignee: Eurotech International Partnership, London, England

[21] Appl. No.: 875,605

[22] Filed: Jun. 18, 1986

[30] Foreign Application Priority Data

Jun. 19, 1985 [GB] United Kingdom ..... 8515576

[51] Int. Cl.[4] ..... F04D 19/02; F04D 29/04; F04D 29/34

[52] U.S. Cl. ..... 415/122 R; 415/170 A; 415/189; 415/199.6; 415/219 R; 415/143

[58] Field of Search ..... 415/121 B, 170 A, 174, 415/189, 190, 198.1, 199.4, 199.5, 199.6, 143, 67, 62, 66, 201, 122 R

[56] References Cited

U.S. PATENT DOCUMENTS

| | | | |
|---|---|---|---|
| 1,861,924 | 6/1932 | Karlstrom et al. | 415/199.5 X |
| 3,286,641 | 11/1966 | Delao et al. | 415/199.5 X |
| 3,367,274 | 2/1968 | Lombard | 415/170 A |
| 3,692,420 | 9/1972 | Mittelstaedt | 415/143 X |
| 3,723,019 | 3/1973 | Berman | 415/143 X |
| 4,082,477 | 4/1978 | Kronogard | 415/143 X |
| 4,097,186 | 6/1978 | Budris | 415/199.6 X |
| 4,523,900 | 6/1985 | Frey | 415/143 X |

FOREIGN PATENT DOCUMENTS

| | | | |
|---|---|---|---|
| 751416 | 9/1933 | France | 415/121 B |

*Primary Examiner*—Robert E. Garrett
*Assistant Examiner*—Joseph M. Pitko

[57] ABSTRACT

A pump for pumping liquids includes a casing formed by upper and lower casing parts secured together. The upper casing part houses a centrifugal rotor having blades which direct liquid to a volute and the lower casing part houses an axial lift impellor which supplies liquid to the centrifugal rotor by way of fixed blades. The lower casing part also houses a further rotor which induces flow of liquid through the pump inlet. The rotor is directly connected to a drive shaft and the centrifugal rotor and impellor are coupled to the shaft preferably through step up gearing.

9 Claims, 3 Drawing Sheets

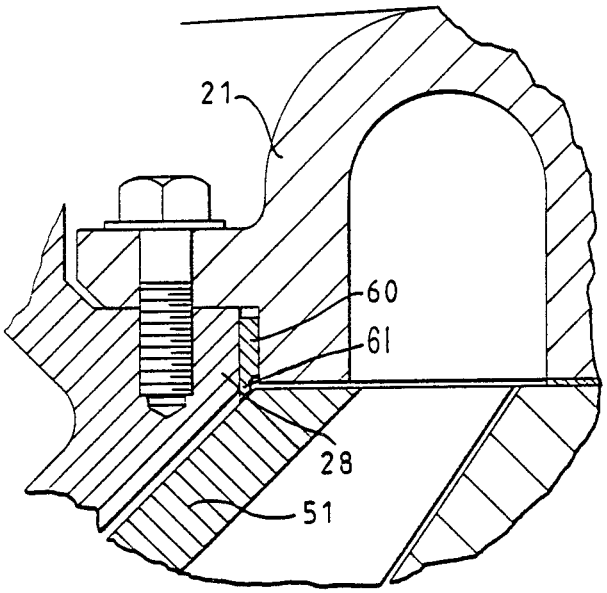
FIG 2
FIG 3
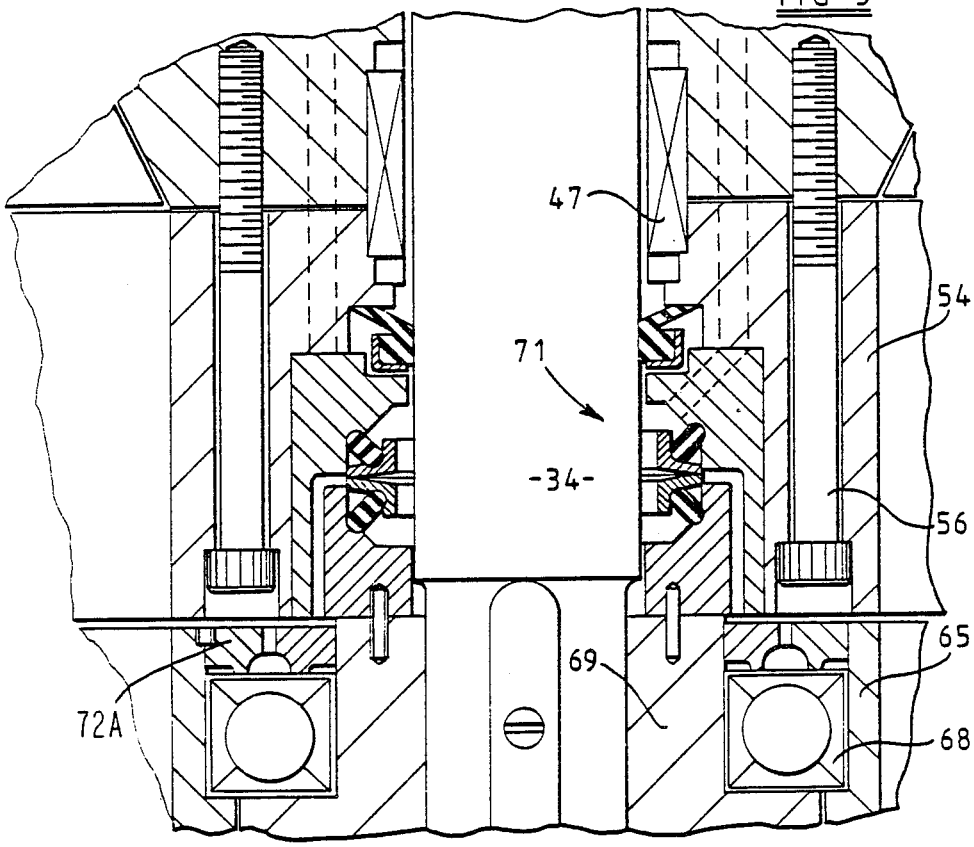

PUMP

This invention relates to a pump for pumping liquid more particularly but not exclusively liquids which are heavily contaminated with solid material.

An example of such a liquid is a slurry of water and coal dust. One form of pump used for pumping such a liquid is a primed or suction lift slurry pump having a flexible or rigid inlet pipe reaching from below the liquid surface to the inlet of the pump. The submerged end of pipe is usually fitted with a foot valve and this is protected with a strainer basket. In the event that the basket becomes blocked the suction pipe has to be removed and cleaned and the foot valve checked and cleaned. Damage to the suction pipe which allows ingress of air will cause a substantial reduction in the output of the pump and could also cause cavitation within the pump. Another form of pump is the flooded suction type of pump in which the pump body is either partly or wholly submerged. Even this form of pump cannot deal with highly aerated slurries having solids in suspension.

The object of the invention is to provide a pump for the purpose specified in a simple and convenient form.

According to the invention a pump for the purpose specified includes a casing defining a lower inlet which can be submerged below the surface of the liquiid to be pumped, a rotary drive shaft located in the casing and adapted to be driven by motor means mounted on the casing, a centrifugal rotor located about the shaft the rotor directing liquid to a volute defined by the casing and connected to an outlet, an axial lift impellor located about the shaft for directing liquid upwardly into the centrifugal rotor and at least a further rotor driven by the shaft for inducing liquid flow through the inlet.

Figure 1:
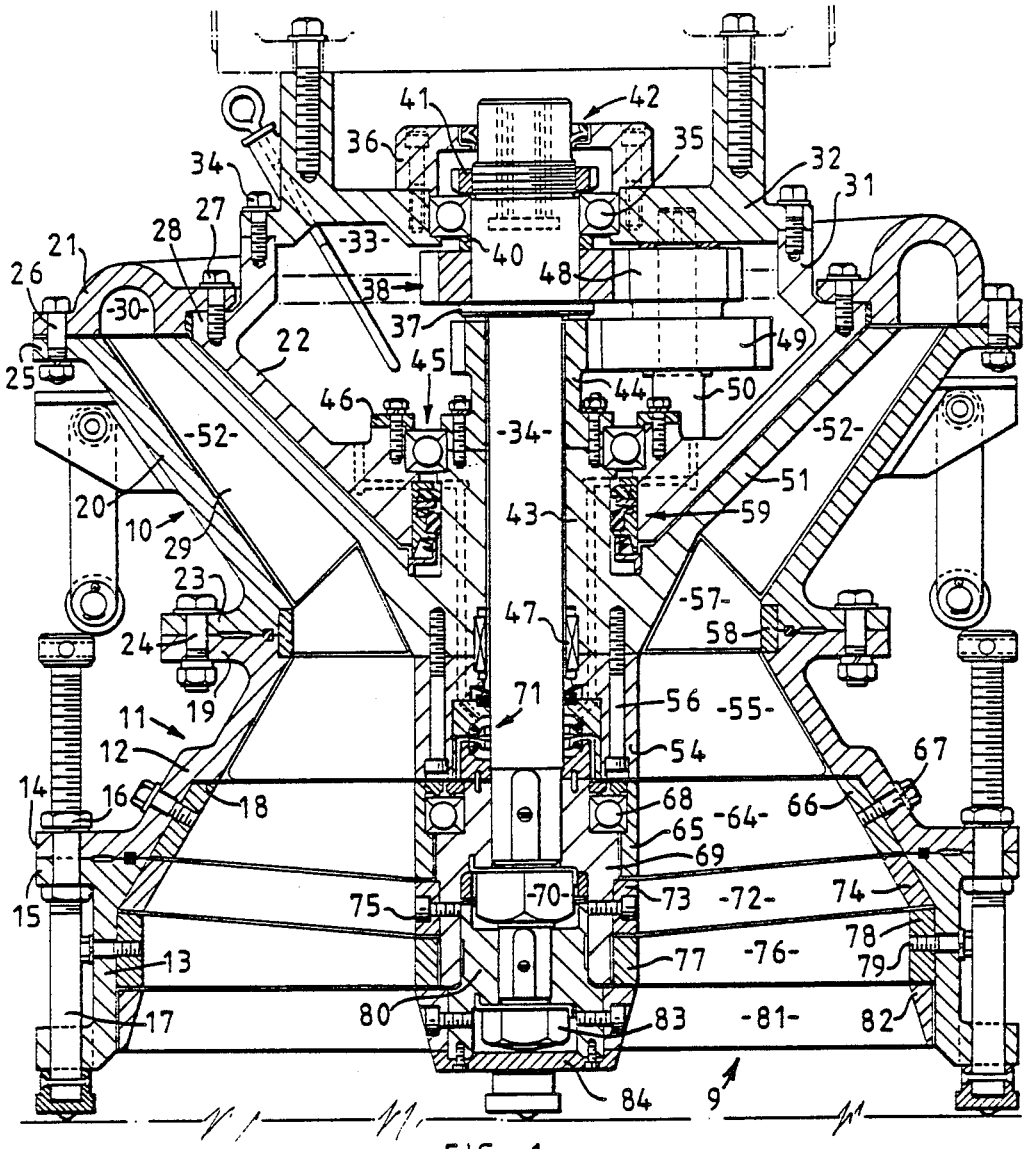
Figure 4:
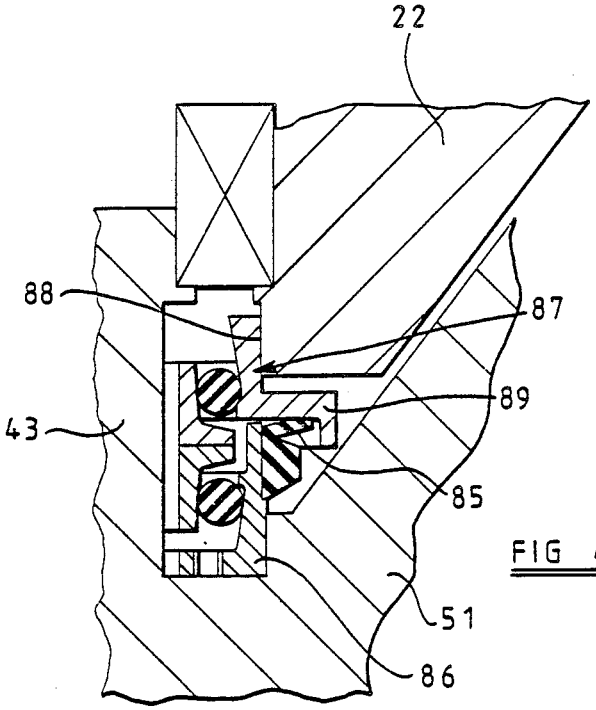

In the accompanying drawings:

FIG. 1 is a sectional side elevation of one example of a pump in accordance with the invention, FIGS. 2 and 3 are views of parts of the pump seen in FIG. 1 to an enlarged scale, and, FIG. 4 is a view to an enlarged scale of a modification to a portion of the pump of FIG. 1.

With reference to FIG. 1 the pump comprises a casing and for the convenience of description the casing is divided into two sections 10, 11, the section 10 being the upper casing and the section 11 the lower casing. Each of the upper and lower casings are formed from a number of parts which are bolted together during the assembly of the pump and can be separated very easily to allow maintenance of the pump, and the two casings are secured together.

Considering the lower casing 11 in the lowest portion of which is defined the pump inlet 9, this is formed by an upper part 12 and a lower part 13. The upper part is of hollow truncated form defining a downwardly and outwardly extending chamber, the lower part being of hollow cylindrical form. The two parts define flanges 14, 15 which are apertured to receive securing bolts 16 whereby the two parts can be secured together. The lower part 14 has a plurality of bosses which receive adjustable support bolts 17 whereby the height of the lower edge of the lower part 13 above the supporting surface can be adjusted.

The upper part 12 of the lower casing 11 defines an internal step 18 and at its upper edge is provided with a flange 19.

Considering now the upper casing 10. This is formed in three parts 20, 21, 22. The part 20 is of hollow truncated form but in this case it extends upwardly and outwardly. The part 20 at its lower end is provided with a flange 23 which can be secured by bolts 24 to the flange 19 of the casing part 12. At its upper end the part 20 defines an annular flange 25 substantially normal to the vertical axis of the pump. The part 21 is secured to the flange 25 by a series of bolts 26 and is in turn secured by a further series of bolts 27 to a shoulder 28 on the part 22. The part 22 is again of annular truncated form and it defines with the part 20 a pump chamber 29 the cross section of which tapers upwardly and outwardly. The part 21 defines a volute space 30 leading to an outlet of the pump.

The shoulder 28 of the part 22 is extended inwardly and upwardly to define an annular mounting 31 for a drive motor support 32, the support being secured to the mounting by means of bolts 34 and the mounting 32 and the inner surface of the part 22 defining a housing 33 for gearing as will be explained.

Extending within the pump casing is a central drive shaft 34. The drive shaft is directly supported by means of a sealed ball thrust bearing 35 which is housed in the motor support 32 and is retained therein by a bearing cap 36 detachably secured to the support 32. The shaft is provided with a collar 37 against which is located a pinion 38 and between the pinion and the bearing is a spacer ring 40. A locknut 41 is provided on a threaded portion of the shaft to retain the collar, the pinion and ring against the inner member of the bearing and the bearing cap also supports a seal member 42 which prevents dirt reaching the bearing from the exterior of the casing.

Surrounding the shaft in spaced relationship is a rotor boss 43 which at its upper end is detachably keyed to a pinion 44 which also surrounds the shaft in spaced relationship. The pinion and boss are shaped to locate the inner member of a ball thrust bearing 45 the outer member of which is located in a bore defined by the part 22 of the casing and is retained therein by an annular retaining member 46. At its lower end the boss 43 is bored to define the outer race of a needle bearing 47, the inner race thereof being mounted about the shaft.

The pinion 38 is keyed to the shaft and engages with a smaller pinion 48 which is coupled to a larger pinion 49 engaged with the pinion 44. The pinions 48 and 49 are mounted on a support spindle 50 located by the casing part 22 and the motor support 32. As shown there is only one set of pinions 48, 49 but further sets may be provided depending upon the power to be transmitted, and of course, the gear ratio can be altered. The gearing is located in the chamber 30 which is partly filled with oil to provide for lubrication of the pinions and the bearings of the pinions 48 and 49. The pinion configuration is such that the boss 43 rotates at a higher speed than the shaft 34. The needle bearing 47 is also lubricated by the oil in the chamber through passages formed in the boss and the casing part 22.

Located in the pump chamber 29 is a main pumping rotor including a backing disc 51 which is formed integrally with the boss 43. The disc is located adjacent the wall of the chamber defined by the casing part 22 and carries blades 52. The blades are backwardly curved and in the particular example, there are six blades, the number of blades being chosen for the particular task. The boss 43 of the main pumping rotor is coupled by bolts 56 to a boss 54 of an impellor which has blades 55 located in the upper portion of the casing part 12. The blades 55 of the impellor which are of aerofoil section, are constructed to lift the liquid axially and the liquid is supplied to the main pumping rotor by way of a set of vertical fixed blades 57 which are radially disposed and are carried by an outer ring support 58 held in position between the casing parts 12 and 20. The blades 57 act to control the vortex produced by the blades 55. The rate of delivery of the impellor is arranged to be slightly in excess of the pumping capability of the main pumping rotor so that the latter is maintained full of liquid and the risk of cavitation is minimised.

The chamber 29 in use will contain liquid under pressure and it is important to prevent the liquid reaching the bearing 45. A seal assembly 59 is therefore provided which includes a plurality of resilient seal members. In addition to the seal assembly 59 a barrier seal is provided between the rim of the backing disc 51 and the casing part 20. As shown in FIG. 2 the seal comprises a body portion 60 of annular form which is trapped between the casing part 21 and the shoulder 28 and depending from the body portion is a lip 61 which bears against the backing disc 51. Conveniently the barrier seal is formed from a moulded strip of ultra high molecular weight polyethelene which is cut to the required length and is secured by contact adhesive to the shoulder 28, the ends of the strip also being secured by contact adhesive. The portion of the backing disc which is engaged by the lip is polished to a high surface finish and the seal acts to prevent grit being forced behind the backing plate and it also acts to reduce the pressure applied to the seal assembly 59.

The aforesaid impellor is located within the casing part 12 and below the impellor and also accommodated on the casing part 12 is a fixed set of blades 64 which are backwardly curved and which are connected at their inner and outer ends to inner and outer support rings 65, 66 respectively. The ring 66 is located against the step 18 and is secured to the casing part 12 by bolts 67. The inner ring 65 defines an internal step which supports the outer member of a sealed bearing 68 the inner member of which is carried on a sleeve 69 which is mounted on and keyed to a reduced portion of the shaft 34. The sleeve is retained on the shaft by a nut 70. The upper end of the sleeve as shown in FIG. 3 is pinned to one component of a mechanical seal assembly 71, the other component of the seal assembly 71 being carried by the boss 54. The seal assembly prevents ingress of dirt into the needle bearing 47 and a back up lip seal is provided between the assembly 71 and the bearing. The seal assembly 71 is also lubricated and cooled by the oil in the chamber 33.

The bearing 68 provides additional support for the shaft 34 and the space between the outer member of the bearing and the adjacent end of the boss 54 is occupied by an annular retainer 72A which is secured by grub screws within the inner support ring 65.

The sleeve 69 carries a further rotor which comprises forwardly curved blades 72 of aerofoil section located between inner and outer support rings 73, 74. The ring 73 is secured to the sleeve 69 by a plurality of bolts 75. The outer surface of the ring 74 runs in close proximity to the casing part 13 and is of complementary shape. The blades 72 accelerate the liquid towards the impellor blades 55. The casing part 13 carries a further set of fixed blades 76 which extend between inner and outer rings 77, 78, the ring 78 being secured in the casing part 13 by means of bolts 79.

At the lower end of the shaft 34 there is mounted a boss 80 which carries a plurality of blades 81 connected to a rim 82 running with clearance within the casing part 13. The boss is keyed to the shaft and is retained thereon by a nut 83. Access to the nut is provided by a cover plate 84 secured in position by screws.

The blades 81 and 76 are shaped to perform a cutting action on solid material entering into the pump through the inlet and they are therefore formed from high strength material. They do not assist in the pumping action of the pump except that they do act to macerate the solid material to facilitate the pumping action of the pump. In order to facilitate the cutting action of the blades, the blades 76 extend tangentially to the sleeve 69 and are of rhomboid section with the lower surface leading in the direction of rotation of the pump. The blades 81 are of the same section but with the upper surface trailing in the direction of pump rotation. Moreover, the blades 81 when viewed in plan are of "S" configuration so that a scissor like cutting action is provided. The clearance between the presented surfaces of the blades is very small, this clearance being established by means of shims which are engaged by the inner end of the boss 80. The blades 72 do however induce liquid flow to the impellor assisted by the fixed blades 64 and as stated the liquid passes from the impellor blades to the main pumping rotor where the main pumping action takes place. Each time the liquid passes from rotating blades to fixed blades and from fixed blades to rotating blades there is a positive chopping action of the solid material in the liquid. The majority of the cutting action takes place between the blades 81, 76 and 72, the blades 72 and 81 being driven at a low speed with the blades 55 and 52 being driven at a higher speed through the aforesaid gearing.

The material forming the blades both fixed and rotating is chosen to resist wear and an example of such a material is that of manganese steel. The remaining portion of the casing can be formed from for example NI-Hard.

Even with the use of such materials it is inevitable that some damage may occur in the use of the pump which may necessitate replacement of blades and in any case general wear will gradually take place. The pump has been designed to enable such maintenance or repair as is required to be carried out very quickly.

For example, the blades in the lower casing 11 can be progressively withdrawn after removing the cover plate 84, the nut 83 and the boss 80 with the blades 81. The blades 76 can then be withdrawn after removing the bolts 79. After removing the nut 70 and the bolts 67, the sleeve 69 can be removed with the bearing 68, the blades 72 and the blades 64. By removing the bolts 56 it is possible to remove the boss 54 and the impellor blades 55. From this point in order to remove the blades 57 it is necessary to separate the upper and lower casings by removing the bolts 24. It is then possible inspect the lower edges of blades 52 of the main pumping rotor.

In order to remove the main pumping rotor it is necessary to detach the casing part 20 which is achieved by removing the bolts 26. It is then necessary to remove the motor support 32 by unscrewing the bolts 34. This allows the motor support to be removed along with the shaft 34 following which the pinion 44 is detached from the boss 43 to allow the main pumping rotor to be separated from the casing part 22.

If after the pump has been assembled it is required to change the gear ratio, the motor is removed following by the bearing cap 36. The locknut 41 is then removed from the shaft to allow the motor support 32 to be removed together with the bearing 35. The pinion 38 can then be removed from the shaft and the pinion 48 separated from the pinion 49. Different pinions 38 and 48 can then be fitted to provide the desired gear ratio and the various parts re-assembled.

The pump as described is for use in particularly severe conditions where the solids contents of the liquid is as much as 80% and where there are present large lumps of solid matter. In less severe conditions where it is reasonably certain that there are no large lumps of solid matter the blades 76 and 81 can be omitted and the remaining blades of the pump will reduce the solid matter to a powder. Any plastics sheet or the like which enters the inlet of the pump will be similarly reduced. In such a case the shaft is of reduced length and the depth of the casing part 13 is also reduced.

Moreover, in some situations depending on the head of liquid against which it is desired to pump, it may be possible to dispense with the gearing and to drive all the rotors at the same speed. In this case the shaft is keyed to the bosses 43 and 54 and the bearing 47 is omitted.

In FIG. 4 of the drawings there is shown a modified sealing arrangement for effecting a seal between the casing part 22 and the boss 43. The main seal is a lip seal component 85 the body of which is carried upon the outer peripheral surface of a support 86 which is of annular form having an "L" section. The base of the support 86 is a press fit, within a recess in the boss 43 and the lip of the seal component 85 engages with a smooth radial surface defined on a member 87 again of annular form, which is an interference fit within an axially extending annular surface 88 defined by the casing part 22. The member is of "L" section but has a downwardly extending lip 89 about the outer edge of the surface engaged by the lip of the seal component. This surface extends inwardly beyond the upstanding limb of the member 86. In order to position the member 87 the limp of the member 86 is provided with a plurality of small upwardly extending projections which can engage the aforesaid surface of the member 87. The arrangement is such that during assembly, as the bolts securing the pinion 44 to the boss 45 are tightened, the projections will urge the member 87 to its correct position relative to the casing part. As the pump is used the ends of the projections and the surface will become polished until a working clearance is established. The adjustment of the seal during assembly is therefore achieved automatically during assembly.

The seal provided as described above is backed up by a conventional mechanical face seal the elements of which are supported by the members 86 and 87 respectively. Such a seal as shown in FIG. 4 can be used to protect a shaft lying in any position and will adequately satisfy a wide range of applications.

I claim:

1. A pump for pumping liquid, comprising a drive motor, upper and lower casing sections, means detachably securing the sections together, an inlet defined by the lower casing section, the inlet in use being submerged below the surface of the liquid to be pumped, a centrifugal rotor connected to said drive motor and mounted on the upper casing section, a volute defined by the upper casing section to receive liquid pumped by the rotor, an outlet connected to said volute, bearing means carried by the upper casing section the bearing means supporting the centrifugal rotor for rotation, a shaft attached to said drive motor and extending through said casing sections, said rotor and said shaft being connected to said drive motor in a manner which will permit the rotor to rotate at speed that is different from the speed of rotation of said shaft, further bearing means carried by the upper casing section for supporting the shaft adjacent its upper end, means coupling the shaft to said centrifugal rotor, the upper end of the shaft being adapted for connection to said drive motor mounted in use on the upper casing section, an axial lift impellor located about the shaft and detachably mounted on the centrifugal rotor so as to rotate therewith and to direct liquid upwardly to the rotor, a first set of fixed blades mounted on a ring support which is mounted by a trap fit between two adjacent casing sections, said fixed blades directing liquid between the impellor and the centrifugal rotor, a further rotor coupled to the shaft so as to be driven thereby, said further rotor inducing liquid flow through the inlet, a second set of fixed blades located between the impellor and said further rotor, inner and outer support rings connected to the second set of fixed blades, means detachably securing the outer support ring within the lower casing section, a sleeve secured to said shaft and a bearing mounted between the inner support ring and said sleeve.

2. A pump according to claim 1 in which said lower casing section is formed in two parts the first of which is of hollow truncated form defining a downwardly and outwardly extending chamber and having flanges at its upper and lower ends, the first part mounting said outer support ring of the second set of fixed blades, the second part of the lower casing section being of hollow cylindrical form and having an upper flange and detachably secured to the lower flange of the first part and means carried by the lower casing section for supporting the pump on a support surface.

3. A pump according to claim 2 including a third set of fixed blades carried in the second part of the lower casing section adjacent said further rotor and a set of rotating blades carried by the shaft, said set of rotating blades and said third set of fixed blades acting to macerate lumps of solid material entering through the inlet of the pump.

4. A pump according to claim 3 in which said upper casing section is formed in three parts the first part being of hollow truncated form and extending outwardly and upwardly from the lower casing section, the first part at its upper and lower ends being formed with flanges, the second part being of annular truncated conical form and being located within the first part to define therewith a pump chamber which tapers upwardly and outwardly and accommodates the centrifugal rotor, the second part defining a shoulder at its upper end and said shoulder and the upper flange of the first part being connected to the third part, said third part defining said volute at the upper end of the pump chamber.

5. A pump according to claim 4 in which said second part of the upper casing section defines a chamber, a motor support member serving to close the upper end of the chamber and carrying the further bearing means for the shaft.

6. A pump according to claim 5 including a boss on said centrifugal rotor, said first mentioned bearing means mounting said boss relative to the second part of the upper casing section, seal means acting between said boss and said second part of the upper casing and gearing located in said chamber and coupling the shaft to said boss and a boss mounting the blades of said impellor, said bosses being secured together whereby the impellor and centrifugal rotor rotate at the same speed.

7. A pump according to claim 6 including a needle bearing interposed between said bosses and the shaft and further seal means for preventing the ingress of liquid to said needle bearing.

8. A pumping according to claim 6 in which said centrifugal rotor includes a backing disc integral with the boss said backing disc being located adjacent the second part of the upper casing section and seal means including a body trapped between the second and third parts of the upper casing section the body carrying a lip which contacts the backing disc.

9. A pump according to claim 6 in which said seal means includes a pair of annular metallic members located within recesses defined by the boss and the second part of the casing a lip seal component carried by one of the members and engaging a surface defined on the other member, each member defining a locating surface engageable with the locating surface on the other member during assembly of the seal, said locating surfaces acting to locate the members relative to each other during assembly said surfaces being polished during the initial operation of the pump.

* * * * *